US009536406B2

(12) United States Patent
Sheflin et al.

(10) Patent No.: US 9,536,406 B2
(45) Date of Patent: Jan. 3, 2017

(54) SYSTEM AND METHOD OF MOTION DETECTION AND SECONDARY MEASUREMENTS

(71) Applicant: Honeywell International Inc., Morristown, NJ (US)

(72) Inventors: Daniel J. Sheflin, Ponce Inlet, FL (US); Kenneth L. Addy, Massapequa, NY (US); Aravind Padmanabhan, Plymouth, MN (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 70 days.

(21) Appl. No.: 14/293,517

(22) Filed: Jun. 2, 2014

(65) Prior Publication Data

US 2015/0348387 A1 Dec. 3, 2015

(51) Int. Cl.

| | |
|---|---|
| ***G08B 1/08*** | (2006.01) |
| ***G08B 19/00*** | (2006.01) |
| ***G08B 13/24*** | (2006.01) |
| ***G08B 25/10*** | (2006.01) |

(52) U.S. Cl.

CPC ..... *G08B 19/00* (2013.01); *G08B 1/08* (2013.01); *G08B 13/2494* (2013.01); *G08B 25/10* (2013.01)

(58) Field of Classification Search

CPC ..... G08B 25/00; G08B 21/22; G08B 29/16
USPC ..... 340/539.22, 541, 545.1, 545.2, 565
See application file for complete search history.

(56) References Cited

U.S. PATENT DOCUMENTS

| | | | | |
|---|---|---|---|---|
| 8,955,022 | B2 * | 2/2015 | Poder | G08B 25/008 340/500 |
| 9,007,222 | B2 * | 4/2015 | Mittleman | H04L 12/282 340/511 |
| 2006/0267756 | A1 | 11/2006 | Kates | |
| 2009/0051528 | A1 * | 2/2009 | Graichen | G07C 9/00103 340/547 |
| 2013/0049978 | A1 | 2/2013 | Piel et al. | |
| 2014/0266674 | A1 * | 9/2014 | Nye | G08B 29/06 340/507 |

FOREIGN PATENT DOCUMENTS

WO WO 2013/134892 A1 9/2013

OTHER PUBLICATIONS

Extended European search report for corresponding EP application 15167233.4, dated Nov. 9, 2015.

* cited by examiner

*Primary Examiner* — Toan N Pham
(74) *Attorney, Agent, or Firm* — Husch Blackwell LLP

(57) ABSTRACT

A regional monitoring system in communication with a plurality of locally displaced detectors can implement a fusion of inputs from a variety of additional non-system devices. The monitoring system includes a wireless receiver or transceiver enabling the system to detect local traffic from the non-system devices, such as sensors. Information received from such non-system devices can be combined with information from system detectors to initiate activity on other networks, to energize actuators, or to activate system detectors that normally reside in a low energy inactive state.

18 Claims, 1 Drawing Sheet

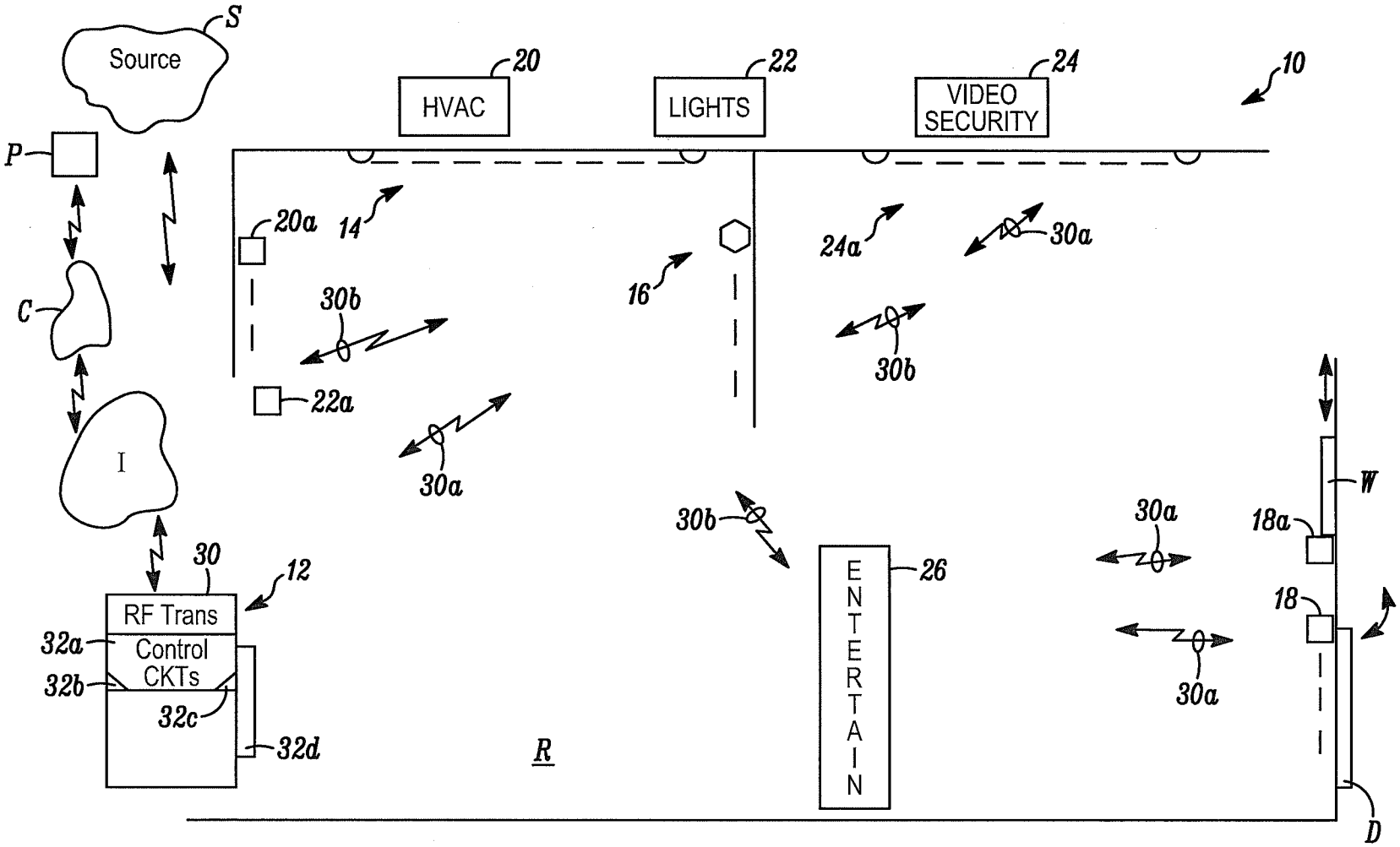
10
VIDEO SECURITY
24
LIGHTS
22
HVAC
20
W
18a
18
D
30a
24a
30b
26
ENTERTAIN
16
R
14
20a
22a
12
32d
30
RF Trans
Control CKTs
32c
32a
32b
S
Source
P
C
I

SYSTEM AND METHOD OF MOTION DETECTION AND SECONDARY MEASUREMENTS

FIELD

The invention pertains to monitoring systems. More particularly, the invention pertains to such systems that can monitor selected conditions in a region and can take into account local wireless traffic not part of the respective monitoring system in making a determination as to the existence of one or more predetermined conditions.

BACKGROUND

Known security monitoring systems currently make decisions based on the inputs from security related detectors distributed around a building. These might include motion detectors, pressure mats, door contacts, and the like, all without limitation. Other types of signals emitted by non-system devices might contain other types of information that could be used, if accessible, advantageously by a local monitoring system.

BRIEF DESCRIPTION OF THE DRAWINGS

FIG. 1 illustrates a block diagram of a system in accordance herewith.

DETAILED DESCRIPTION

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

Many commercial buildings and residences contain one or more monitoring systems. Increasingly, commercial buildings and residences include additional devices or detectors that include sensors that are not part of the security system. For example, such sensors that are not part of the security system can include a motion detector in a thermostat, a camera system in a gaming console, cameras and microphones in computers, telephones, external lighting, temperature sensors, and weather stations, all without limitation.

Such systems based on existing conditions are usually capable of energizing various types of actuators to unlock or close doors or to energize camera recording systems.

Embodiments hereof improve aspects of the operation of such systems by fusing inputs from a variety of additional sensors that may not directly be part of the security system. These additional detected inputs could improve security system determinations by providing additional inputs that can be included in a decision making process.

In accordance with the above, the reliability of a detected alarm can be improved, thereby reducing false alarms. For example, information gathered from other sensors in the building or region being monitored, such as recent historical data along with readings for several seconds after an alarm determination has been made, can be taken into account before making a decision to call first responders. In this regard, the secondary measurements or information could be "weighted" and combined to make a final decision.

In one aspect, since security systems are "always on" by nature to provide 24/7 coverage, security system processing could initiate activity on other non-security networks. To improve the QOS/reliability of wi-fi alarm messages, an alarm trigger could be used to turn off the wi-fi activity from other devices in the region of interest. For example, a dongle in the USB port of a router can shut off all other traffic except streaming video from security cameras.

In another aspect, signals from non-system sources can be used as a basis for actuating security system devices, which can normally be in a low energy default state to extend useful battery life. For example, to improve battery lifetime of wireless devices, higher current battery powered devices, such as wireless cameras, can be placed into a very low current state until awakened by a signal from a device that is continuously powered.

The above requires an underlying wireless network with always-on nodes to collect and reformat messages into a protocol for synchronized "paging" of mostly-off devices. For example, a USB Tx/Rx plugged into a gaming system can detect/see human activity and, in response thereto, wake up or energize the wireless cameras in other parts of a home.

Additional embodiments, without limitation, include providing control of actuators by a variety of sensors that may or may not be part of the actuation system. In this regard, a CO detector that has gone into alarm can be used to turn on air conditioning and an associated fan to rapidly refresh the air in an area. Coverings, such as blinds or drapes, can be closed if a room is becoming too warm due to sunlight. Alternately, in winter, if a furnace is running, then criteria could be incorporated to automatically close the coverings to reduce heating expenses, or the widows can also be locked in such conditions.

In another aspect, wirelessly controlled doors, such as z-wave operated doors, can be unlocked in an alarm event. This could prevent axe damage from first responders.

FIG. 1 illustrates a block diagram of a system 10 in accordance herewith. A region R is being monitored by a monitoring system 12. The monitoring system 12 can communicate, wired or wirelessly, with a plurality of ambient condition detectors, such as fire, smoke, or gas detectors 14, as well as with a plurality of intrusion detectors 16 that sense motion, position, or audio, all as would be understood by those of skill in the art.

The system 12 can also be in wired or wireless communications with a variety of actuators, including door control, locking, and unlocking systems 18 for doors, such as door D, or window locking, unlocking, opening or closing systems 18*a* for windows W. Other types of actuators could include fans, pumps, or the like, all without limitation.

It will also be understood that other types of monitoring systems such as heating ventilating air conditioning systems (HVAC) 20 (with one or more wireless thermostats 20*a*), lighting control systems 22 (with one or more wireless illumination sensors 22*a*), or video security imaging systems 24 (with cameras 24*a*), could also be used in the region R along with an entertainment system 26.

The monitoring system 12 can include a wireless RF transceiver 30 for wireless communications 30*a* with the various units 14, 16, 18, where those units are part of the monitoring system 12. The transceiver 30 can also communicate directly 30*b* or via the Internet I with internet enabled members of the pluralities 14, 16, 18, 18*a*.

Other types of systems, such as the systems 20, 22, 24, 26, without limitation, in or in the vicinity of the region R are not part of the monitoring system 12. All such systems 20, 22, 24, 26 might emit wireless signals, such as 30*b*, detectable by a transceiver 30. Similarly, the related wireless control units 20*a*, 22*a* could also emit detectable signals 30*b*.

The monitoring system 12 can also include control circuits 32*a* coupled to the transceiver 30. The control circuits 32*a* can be implemented, at least in part, by one or more programmable processors 32*b* along with executable instructions 32*c*. A manually operable control panel and a visual display 32*d* can be coupled to the control circuits 32*a* via a wired or wireless interface.

In summary, wired or wireless signals from those members of the pluralities 14, 16, 18 that are not part of the system 12 as well as other systems, such as 20, 22, 24, 26, and their respective wireless control units, such as 20*a*, 22*a*, can be detected by the system 12. These signals can be incorporated, as discussed above, into making alarm determinations, activating devices in a non-active state, or energizing actuators to open or close doors or windows, operate fans, turn lights on or off, enable video cameras, or the like without being part of the system 12.

In yet another aspect, the units that are not part of the local system, such as the system 12, can be physically displaced from the system 12. They can include internet enabled sources S or cellular-type units P that can communicate via a local cell system C. In this regard, user activity in one location can, via the internet or cellular systems, such as the system C, trigger events in a different system. For example, locking an office door at work can be communicated to a home security system, such as the system 12, to turn on heat or lights or report security system/video status back to a mobile phone, such as the cellular unit P. Hence, remote as well as local event actions can be responded to by a local system, such as system 12.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising:

a regional monitoring system that includes a plurality of system-based detectors; and circuitry to respond to at least one non-system unit, wherein the at least one non-system unit emits wireless signals that are received by the circuitry that, responsive thereto, at least in part, implements a function selected from a class that includes at least one of altering an operational element or process of the regional monitoring system, emitting a condition indicating signal, energizing an actuator, or activating at least some of the plurality of system-based detectors for at least intermittent operation, wherein the at least one non-system unit performs additional specified functionality that is independent of the regional monitoring system, and wherein the circuitry makes an alarm determination responsive to signals from at least one of the plurality of system-based detectors and the wireless signals from the at least one non-system unit.

2. An apparatus as in claim 1 wherein each of the plurality of system-based detectors is selected from a class that includes at least motion detectors, PIR detectors, position detectors, glass break detectors, airborne condition detectors, temperature detectors, and lighting detectors.

3. An apparatus as in claim 1 wherein one of the circuitry or the at least one non-system unit emits the wireless signals to switch selected ones of the plurality of system-based detectors from a low power inactive state to a higher power active state.

4. An apparatus as in claim 1 wherein the circuitry monitors local non-security related traffic, and wherein the at least one non-system unit includes one or more broadband or cellular-type devices that are displaced from the regional monitoring system but that communicate with the circuitry.

5. An apparatus as in claim 1 wherein the regional monitoring system is selected from a class that includes at least a security monitoring system, an airborne condition monitoring system, a heating ventilating air conditioning system, an illumination control and monitoring system, an entertainment system, and a communications system.

6. An apparatus as in claim 1 wherein an actuator is energized in response to the wireless signals from the at least one non-system unit to unlock a door, change an operational state of a fan, open or close a shade or covering, or lock or unlock windows.

7. An apparatus as in claim 6 wherein one of the regional monitoring system or the at least one non-system unit emits the wireless signals to switch selected ones of the plurality of system-based detectors from a low power inactive state to a higher power active state.

8. An apparatus as in claim 7 wherein each of the plurality of system-based detectors is selected from a class that includes at least motion detectors, PIR detectors, position detectors, glass break detectors, airborne condition detectors, temperature detectors, and lighting detectors.

9. An apparatus comprising:

a regional monitoring system that includes circuitry to receive signals emitted by at least one wireless signal emitting device not part of the regional monitoring system, wherein, when the regional monitoring system receives at least some of the signals emitted by the at least one wireless signal emitting device, the regional monitoring system incorporates information therefrom into an alarm indicating determination, wherein the at least one wireless signal emitting device performs additional specified functionality that is independent of the regional monitoring system, and wherein the alarm indicating determination responds to signals from at least one system-based detector and the signals emitted by the at least one wireless signal emitting device.

10. An apparatus as in claim 9 wherein the regional monitoring system includes at least one actuator that is energized as a result of at least one of received airborne information, thermal information, movement information, or intrusion related information.

11. An apparatus as in claim 9 wherein the at least one system-based detector includes at least one of a detector or an output device that is energized, at least in part, as a result of airborne information obtained by the circuitry.

12. An apparatus as in claim 9 wherein activity is initiated by the regional monitoring system on at least one unit not part of the regional monitoring system.

13. An apparatus as in claim 12 wherein the at least one unit includes an output unit that is energized, at least in part, as a result of the information obtained by the circuitry from the at least one wireless signal emitting device.

14. An apparatus comprising:

a monitoring system, the monitoring system including at least a wireless receiver and control circuits coupled thereto, wherein the control circuits process received wireless information from non-system units and incorporate the received wireless information from the non-system units into making an alarm determination, wherein the non-system units perform additional specified functionality that is independent of the monitoring system, and wherein the alarm determination responds to signals from at least one system-based detector and signals from the non-system units.

15. An apparatus as in claim 14 wherein the alarm determination is selected from a class that includes at least determining a presence of an alarm condition, determining that at least one actuator is to be energized, and determining that at least one detector unit is to be energized.

16. A regional monitoring system comprising:

circuitry in communication with a plurality of locally displaced detectors; and at least a wireless receiver enabling the circuitry to detect local traffic from a plurality of additional non-system devices, wherein the circuitry implements a fusion of inputs from the plurality of additional non-system devices, wherein information received from each of the plurality of additional non-system devices is combined with information from each of the plurality of locally displaced detectors to, at least one of, initiate activity on other networks, to energize actuators, or to activate ones of the plurality of locally displaced detectors that normally reside in a low energy inactive state, and wherein each of the plurality of additional non-system devices performs additional specified functionality that is independent of the regional monitoring system.

17. A system as in claim 16 wherein each of the plurality of additional non-system devices includes one or more broadband or cellular-type devices that are displaced from the regional monitoring system but that communicate with the circuitry.

18. A system as in claim 17 wherein user activity in one location triggers, via an internet or cellular systems, events in the regional monitoring system.

* * * * *